US007383799B1

(12) United States Patent
Wynveen et al.

(10) Patent No.: US 7,383,799 B1
(45) Date of Patent: Jun. 10, 2008

(54) METHOD FOR MONITORING THE OPERATING CONDITION OF AN ENGINE VALVE SYSTEM

(75) Inventors: Steve Wynveen, Germantown, WI (US); Claus Bruestle, Forchheim (DE); Timothy S. Reid, Fond du Lac, WI (US); Eric S. Mueller, Fond du Lac, WI (US)

(73) Assignee: Brunswick Corporation, Lake Forest, IL (US)

( * ) Notice: Subject to any disclaimer, the term of this patent is extended or adjusted under 35 U.S.C. 154(b) by 161 days.

(21) Appl. No.: 11/249,537

(22) Filed: Oct. 13, 2005

(51) Int. Cl.
*F01L 1/34* (2006.01)

(52) U.S. Cl. ..... 123/90.15; 123/90.16; 123/90.31

(58) Field of Classification Search ..... 123/90.15, 123/90.16, 90.31, 90.4, 90.43
See application file for complete search history.

(56) References Cited

U.S. PATENT DOCUMENTS 4,620,446 A * 11/1986 Jensen et al. ..... 73/652
4,638,772 A 1/1987 Burandt ..... 123/90.6
5,140,962 A * 8/1992 Iwata ..... 123/406.35
5,806,478 A * 9/1998 Oberg ..... 123/90.61
6,275,765 B1 8/2001 Divljakovic et al. ..... 701/102
6,285,947 B1 9/2001 Divljakovic et al. ..... 701/110
6,745,734 B2 6/2004 Pierik ..... 123/90.16
6,845,312 B1 1/2005 Cross et al. ..... 701/111
2001/0020458 A1* 9/2001 Mikame ..... 123/90.15

FOREIGN PATENT DOCUMENTS

KR 2004043807 A * 5/2004

* cited by examiner

*Primary Examiner*—Zelalem Eshete
(74) *Attorney, Agent, or Firm*—William D. Lanyi

(57) ABSTRACT

A system is provided for monitoring changes in the operation of a valve system of an engine. An accelerometer provides vibration-related signals that are obtained by a microprocessor or similarly configured device and compared to a reference or baseline magnitude. The obtaining step can comprise the steps of measuring, filtering, rectifying, and integrating individual data points obtained during specific windows of time determined as a function of the rotational position of the crankshaft of the engine. These windows in time are preferably selected as a function of the position of exhaust or intake valves as they move in response to rotation of cams of the valve system.

13 Claims, 3 Drawing Sheets

METHOD FOR MONITORING THE OPERATING CONDITION OF AN ENGINE VALVE SYSTEM

BACKGROUND OF THE INVENTION

1. Field of the Invention

The present invention relates generally to a valve system for an internal combustion engine and, more particularly, to a monitoring system that determines the operating condition of the valve system as a function of vibrations created during the operation of the engine.

2. Description of the Related Art

Four cycle internal combustion engines use a valve system that opens and closes the intake and exhaust valve for each cylinder at the appropriate time. Typically, cam shafts with a plurality of cam lobes are used to actuate the movement of the intake and exhaust valves in coordination with the rotation of the crankshaft of the engine.

U.S. Pat. No. 4,638,772, which issued to Burandt on Jan. 27, 1987, describes a valve actuating apparatus for minimizing the need for lash adjustment. A cam unit and a follower at the upper end of the valve stem are configured so that the surfaces between which lash is measured are for all intents and purposes removed or segregated from the surfaces used for effecting valve movement. The modified interaction between the cam and the surface the cam bears against compensates for reduction in valve lash. The segregation is achieved by employing a button having a reduced area engaged by the ramp portions of the cam unit, the ramp portions having a width at least as great as that of the button. In one embodiment, the button is softer than the ramps. Provision is also made for dimensionally correlating the working surface of the cam and follower with the amount of load needed at any given movement to open or close the valve.

U.S. Pat. No. 6,275,765, which issued to Divljakovic et al. on Aug. 14, 2001, discloses a system for providing a prognosis of future engine faults. A method for monitoring an apparatus, such as a marine propulsion system, and determining how various measurements of indicator parameters should be compared to reference magnitudes of those indicator parameters is described. In addition, the method monitors the usage time of the apparatus at various operating conditions to determine whether or not calculated reference magnitudes should be used to determine appropriate and inappropriate power spectral density profiles for various indicator parameters.

U.S. Pat. No. 6,285,947, which issued to Divljakovic et al. on Sep. 4, 2001, discloses a prognostication of future failure of an engine indicator parameter. Power spectral densities are taken at period intervals for preselected indicator parameters and these power spectral density profiles are compared to a reference magnitude of a power spectral density profile for purposes of prognosticated future failures. The power spectral density profile can be for any one of a plurality of indicator profiles, such as an accelerometer output, the output of a pressure sensor, or a voltage output from an ignition system. U.S. Pat. No. 6,745,734, which issued to Pierik on Jun. 8, 2004, describes a variable valve actuating mechanism having torsional lash control spring. A variable valve actuating mechanism includes an output cam pivotally disposed upon an input shaft of an engine. First and second frame members are disposed upon the input shaft on respective sides of the input cam lobe. A first link arm is pivotally coupled at a first end thereof to the first and second frame members. A rocker arm assembly is pivotally coupled at a first end thereof to a second end of the link arm. The rocker arm assembly carries a cam follower that engages an input cam lobe of the input shaft. A biasing means is grounded to the first and second frame members, and biases the cam follower into engagement with the input cam lobe.

U.S. Pat. No. 6,845,312, which issued to Cross et al. on Jan. 18, 2005, discloses a method for detecting engine knock. The method for processing knock related data reduces the memory locations required for the method and also simplifies the processing steps needed to determine a sum, average, and threshold value relating to magnitudes of knock ratios. Inputs from either pressure sensor or accelerometers are filtered and then used to form a ratio between a knock portion of a curve and a reference portion. Sequential magnitudes of the knock ratio are received and analyzed in a manner that reduces required memory locations and improved processing speed.

The patents described above are hereby expressly incorporated by reference in the description of the present invention.

SUMMARY OF THE INVENTION

A method for monitoring a valve system of an engine, in accordance with a preferred embodiment of the present invention, comprises the steps of obtaining a first current magnitude of a parameter which is representative of an operating characteristic of the valve system corresponding to a first operating speed of the engine, comparing the first current magnitude to a first reference magnitude, and determining an operating condition of the valve system of the engine as a function of a difference between the first current magnitude and the first reference magnitude.

In a preferred embodiment of the present invention, an output signal is provided in response to a difference, between the first current magnitude and the first reference magnitude, which exceeds a predetermined threshold value.

The first current magnitude of the parameter can be determined by the step of measuring a first series of sensor output signals within a predefined window of the operational cycle of the valve system. It can further comprise the steps of filtering the result of the measuring step according to a preselected range of frequencies, rectifying the result of the filtering step, and integrating the results of the rectifying step to obtain the first current magnitude of a parameter which is representative of an operating characteristic of the valve system.

The parameter can be an accelerometer signal magnitude which is representative of a magnitude of valve lash within the valve system. The parameter can be a signal which is representative of a magnitude of vibration associated with the operation of the valve system. In certain embodiments of the present invention, the first reference magnitude is preselected as a function of the engine with which the present invention is used. In other embodiments, the reference magnitude is obtained by storing an actual value of the current magnitude of the parameter which was earlier determined when the operating characteristic of the valve system was known to be within acceptable limits.

In certain embodiments of the present invention, it can further comprise the steps of obtaining a second current magnitude of a parameter which is representative of an operating characteristic of the valve system corresponding to a second operating speed of the engine, comparing the second current magnitude to a second reference magnitude corresponding to the second operating speed of the engine, and determining an operating condition of the valve system of the engine as a function of a difference between the second current magnitude and the second reference magnitude. The second current magnitude can be obtained by performing the steps described above in conjunction with the obtaining of the first current magnitude.

BRIEF DESCRIPTION OF THE DRAWINGS

The present invention will be more fully and completely understood from a reading of the description of the preferred embodiment in conjunction with the drawings, in which.

DESCRIPTION OF THE PREFERRED EMBODIMENT

Figure 1:
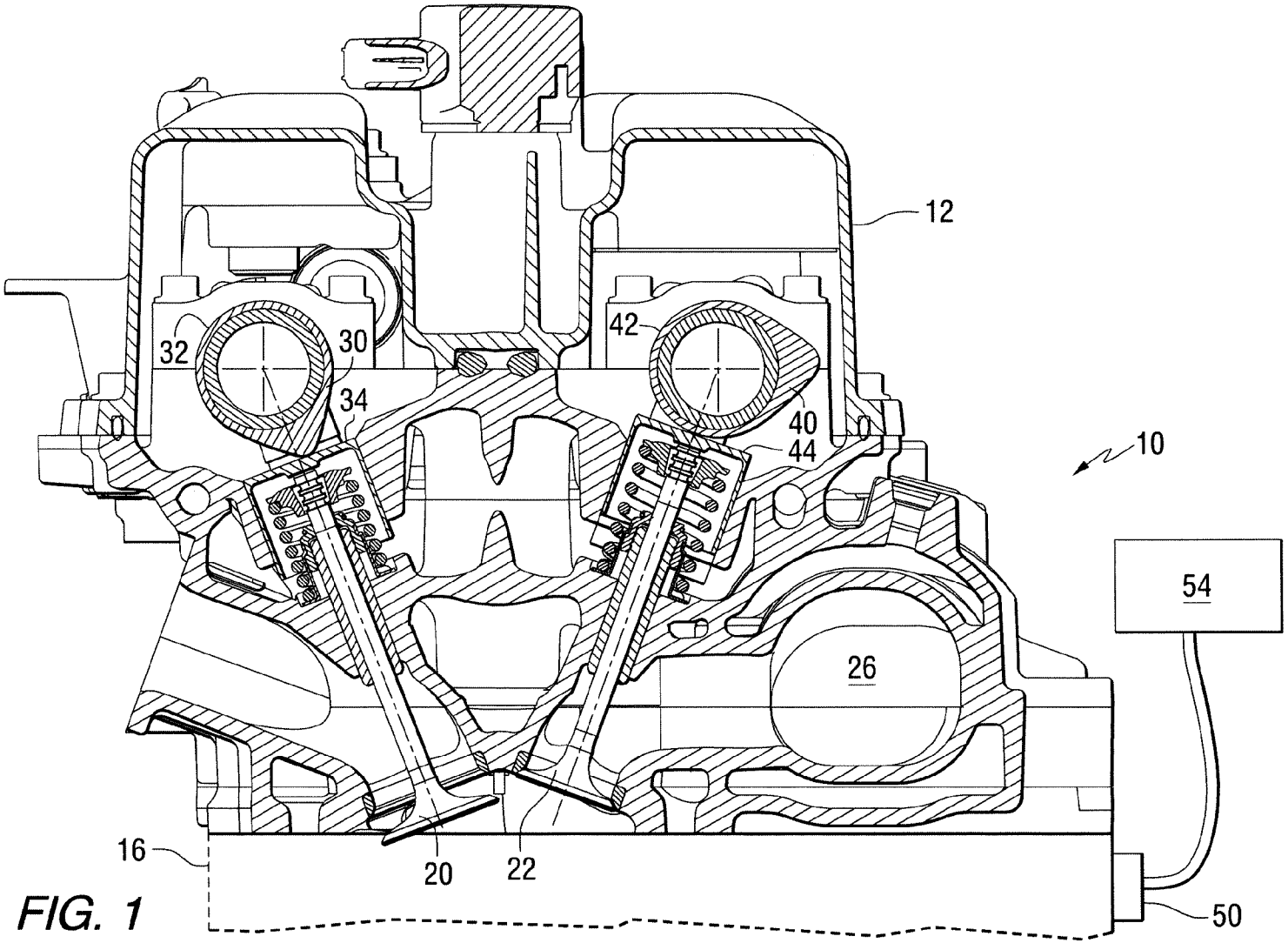
FIG. 1 is a section view of a valve system of an internal combustion engine.

Throughout the description of the preferred embodiment of the present invention, like components will be identified by like reference numerals.

The basic concept of the present invention is that a reference magnitude, or baseline magnitude, is obtained which defines the operating condition of a valve system of an engine when that valve system is known to be operating properly. The reference or baseline magnitude can either be calculated or determined as a function of the type of engine with which the present invention is used.

Alternatively, the reference or baseline magnitude can be empirically determined by actually measuring a current magnitude of the selected parameter when the engine is known to be operating properly. That reference or baseline magnitude is then stored for later comparison to currently measured magnitudes of the same parameter. As will be described below, in a particularly preferred embodiment of the present invention, the parameter is related to an output signal from an accelerometer which measures vibration of the engine. The reason for this selection of an accelerometer as the provider of the signal representing the valve condition is that certain engines are typically provided with such an accelerometer for other purposes, such as determining knock events in the cylinders of the engine. As a result, the method of the present invention can be employed to diagnose the valve system of the engine without requiring significant addition of components and sensors.

FIG. 1 shows a section view of the head 10 of an engine with a valve cover 12 attached thereto. Represented by dashed lines in FIG. 1 is the engine block 16 of the engine. Also shown in FIG. 1 is an intake valve 20 and an exhaust valve 22. The exhaust manifold is identified by reference numeral 26. An intake cam 30 is shown with its lobe in contact with a cam follower surface 34 which transfers force to the intake valve 20. An exhaust cam 40 is shown with its generally circular surface 42 positioned proximate the cam follower surface 44 which transfers force to the exhaust valve 22. Although not readily visible in FIG. 1, any gap between the generally circular surface 42 and the cam follower surface 44 is referred to as "lash". The intake cam 30 also can have a clearance between its circular surface 32 and the cam follower surface 34. This is also referred to as "lash".

Those who are skilled in the art of engine design are familiar with the concept of valve lash and the various techniques and procedures used to properly set a desirable magnitude of valve lash for any particular cam and cam follower of the valve system. In addition, various techniques and components are available to adjust the valve lash. Some of these systems adjust valve lash dynamically as the engine is operating and other procedures are employed, such as by a trained mechanic, to periodically inspect and adjust the valve lash for an engine.

The magnitude of valve lash can change during the lifetime of an engine. Changes at operating temperature of the valve system can affect the degree of valve lash. In addition, wear caused by the sliding contact between the outer surface of the cam and the cam follower surface can also affect the magnitude of valve lash. The primary intent of a preferred embodiment of the present invention is to dynamically monitor the operating condition of the valve system in order to determine when valve lash has changed to a degree which can deleteriously affect the proper operation of the engine.

Reference numeral 50 identifies an accelerometer which is rigidly attached to the engine block 16. It should be understood that the accelerometer 50 can be attached to various locations on either the engine block 16 or the head 10. In some engines, an accelerometer 50 is attached to the engine block for the purpose of detecting engine knock. U.S. Pat. No. 6,845,312, described above, refers to that type of system. The accelerometer responds to vibrations of the engine and provides a signal to a microprocessor 54 which receives the vibration-related signals. An accelerometer 50 which is suitable for use in cooperation with the present invention is sold in commercial quantities by Delphi Engine and Engine Management Systems and is identified as model 10456240. It is also identified as a "flat response knock sensor". However, it should be understood that various other types of accelerometers 50 can be used to collect vibration-related data.

Figure 2:
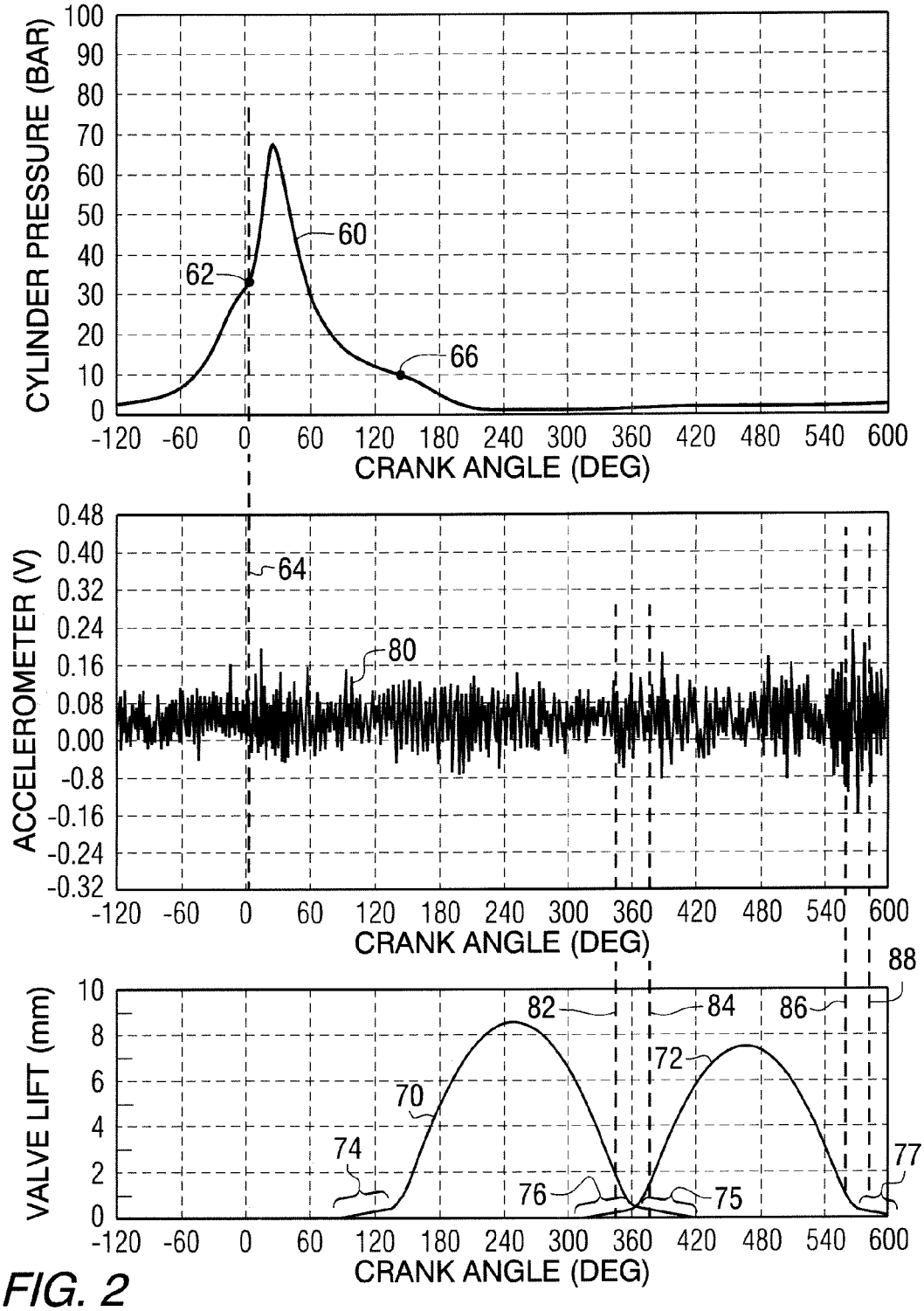
FIG. 2 shows three graphical representations associated with the ignition and valve movement of an internal combustion engine.

FIG. 2 illustrates three graphical representations relating to the conditions within a cylinder of the engine, the output from the accelerometer 50, and the position of the intake and exhaust valves, 20 and 22, described above in conjunction with FIG. 1. The three graphical representations in FIG. 2 are aligned according to the crankshaft rotational angle so that the various incidents described below can be compared to the chronology of rotation of the crankshaft.

In the upper illustration of FIG. 2, a pressure curve 60 illustrates the pressure within a selected cylinder of the engine during the ignition event within that cylinder. Point 62 identifies the time when the ignition occurs. This ignition time is also identified by dashed line 64. For purposes of reference, another point 66 is identified to illustrate when a significant emission of exhaust gas begins to flow past the exhaust valve 22 and out of the cylinder.

In the bottom illustration in FIG. 2, the physical position of the exhaust valve 22 is represented by line 70. Correspondingly, the physical position of the intake valve 20 is represented by line 72. As a function of the shape of the exhaust and intake cams, 40 and 30, the initial movement of the exhaust and intake valves begins with an opening ramp portion, 74 and 76, respectively. As shown in the bottom illustration of FIG. 2, closing ramps 75 and 77 are also provided as a function of the cam shapes. The information illustrated in the top and bottom representations of FIG. 2 are generally known to those skilled in the art and are provided here for the purpose of illustrating the environment in which the present invention operates.

The central illustration in FIG. 2 shows a typical output 80 from the accelerometer 50 which is received either by the microprocessor 54 or an appropriate device that is able to handle the data provided by the accelerometer 50. The changing data identified by reference numeral 80 represents the vibration of the engine which is sensed by the accelerometer 50. As can be seen, it has both positive and negative excursions from a zero level.

The operation of a preferred embodiment of the present invention will be described in relation to a window, shown between dashed lines 82 and 84 that identifies a selected portion of the exhaust valve profile relating to its closing ramp 75. The present invention will also be described in terms of another window, between dashed lines 86 and 88, which define a portion of the closing ramp 77 of the intake valve movement profile. It should be understood that alternative embodiments of the present invention could focus on windows that are associated with the opening ramps, 74 or 76, of the exhaust and intake profiles, 70 and 72, respectively. These choices can be made to more precisely monitor the behavior of the valve systems of different engines, based on the various specific characteristics of those engines and valve systems. The present invention is not limited to using either the opening ramps or closing ramps of the valve profiles such as those shown in the bottom illustration of FIG. 2.

If, for example, the present invention uses data relating to the closing ramp 75 of the exhaust valve 22, the window identified between dashed lines 82 and 84 would define the time period when data from the accelerometer 50 is used to obtain a first current magnitude of the parameter that is representative of the operating characteristic of the valve system. In other words, the data points, or sensor output signals, of the graphical representation 80 located between dashed lines 82 and 84 would be captured by the microprocessor 54. Recognizing that different frequencies of vibration, resulting from various causes, are present in the signal 80, the data within the window between lines 82 and 84 is filtered to select only those data points within a preselected range of frequencies that best represent the vibrational effects of the valve system. For example, in a four cylinder engine, some cylinders are experiencing ignition while other cylinders are experiencing an exhaust cycle. Likewise, some exhaust valves are closing while others are opening. The same is true for intake valves. There are many causes of vibrations within an operating engine. The filtering step, which could select a range of frequencies between 6 kHz and 8 kHz, could be used for these purposes.

In a preferred embodiment of the present invention, a rectifying step is then performed on the filtered data. As can be seen in the central illustration of FIG. 2, the data between dashed lines 82 and 84 include both negative and positive data points. By rectifying these results, the otherwise self-canceling nature of this type of data is avoided. After the filtering and rectifying steps, in a preferred embodiment of the present invention, an integrating step is performed in order to obtain a single magnitude that is representative of the measurement of the parameter. In other words, these steps performed in obtaining the first current magnitude for the window between dashed lines 82 and 84 are intended to yield a single representative number which can be used for comparison purposes.

As described above, the first current magnitude is compared to a first reference magnitude in order to allow the determining step to determine the operating condition of the valve system as a function of the difference between the first current magnitude and the first reference magnitude. In order to obtain the first reference magnitude, or baseline magnitude, an earlier result of the obtaining step is saved and used as the reference or baseline magnitude. This reference or baseline magnitude is preferably obtained at a time when the valve system is known to be operating in an acceptable manner. As an example, after the valve system is adjusted by a skilled mechanic or after the valve system and engine are initially manufactured and tested, an early running of the engine can be used to obtain an initial sample of the first current magnitude which is then used as the reference or baseline magnitude. This value is saved by the microprocessor 54 and used in conjunction with subsequent obtaining steps when later current magnitudes of the parameter are obtained. In alternative embodiments of the present invention, the reference or baseline magnitude can be determined as a function of the engine type rather than through empirical steps as described above.

After the first current magnitude is dynamically obtained during the operation of the engine and valve system, it is compared to the first reference or baseline magnitude. This comparison can comprise a step of dividing the first current magnitude by the first reference magnitude. Initially, the result of this division would provide a number approximately equal to 1.0. If changes occur in the valve system, this division would yield an increasing value. If that increasing value reaches a number which is determined to be unacceptable, the microprocessor would use that information to identify a condition which indicates a changing magnitude of valve lash in the valve system. As a result, an alarm message could be provided to the operator of the engine with a suggestion that the valve lash be inspected to determine if repair or readjustment is required.

In a preferred embodiment of the present invention, the first current magnitude and the first reference magnitude are both obtained at the same operating speed of the engine. That operating speed is preferably a relatively low operating speed, such as idle speed. In addition, the first current magnitude is compared to a first reference magnitude that was obtained at a generally identical engine speed. As an example, the engine speed of 1,000 RPM would be a suitable speed at which to obtain the reference magnitudes and current magnitudes. In certain embodiments of the present invention, it is anticipated that several reference magnitudes would be initially obtained at different engine speeds. As an example, reference magnitudes could be obtained at 1,000, 1,050, 1,100, and 1,150 RPM. Then, as the engine is later operated, the system would obtain a first current magnitude at one of those operating speeds, at which the engine happens to be operating, and perform the comparison described above. It is not necessary to make these comparisons at each of the selected engine speeds during each cycle of the present invention. Instead, it is intended that periodic comparisons of first current magnitudes and first reference magnitudes be made whenever possible and whenever the engine happens to be operating at one of the selected low engine operating speeds.

An alternative embodiment of the present invention could maintain a record of previously obtained first current magnitudes or, alternatively, previous results obtained by dividing first current magnitudes by first reference magnitudes. By storing this information as a function of engine operating hours, for example, a trend line can be determined that could allow the microprocessor to predict a future problem even though the actual valve system is operating satisfactorily at the time. The use of such trend data is not required in all embodiments of the present invention.

Figure 3:
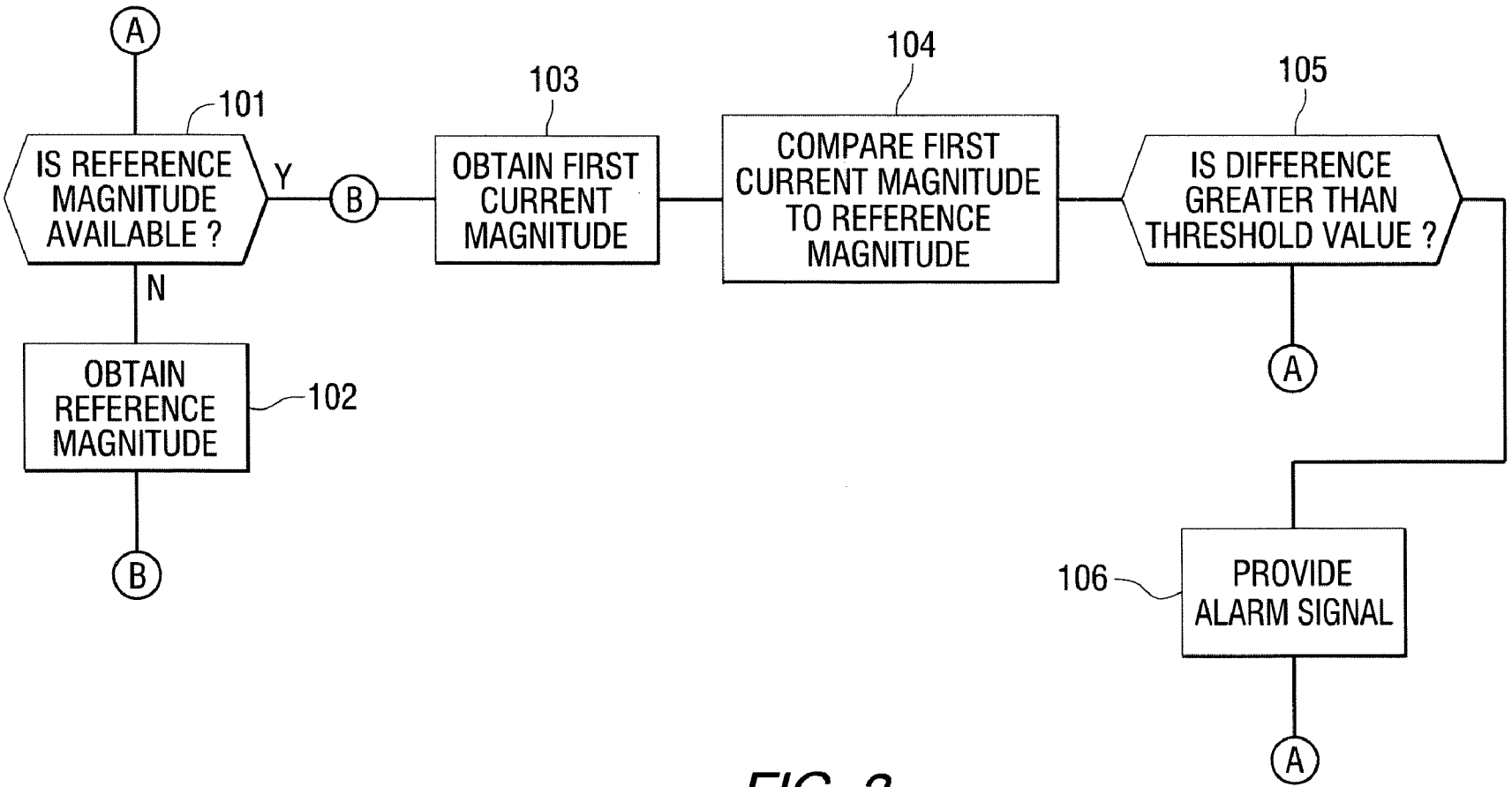
FIG. 3 is a simplified flowchart showing the basic steps of the present invention.

FIG. 3 is a highly simplified flowchart showing the basic steps of the present invention as described above. Beginning at point A, the microprocessor 54 determines whether or not a reference magnitude is available. When the engine is newly manufactured or the valve system is recently adjusted, a new reference magnitude should be obtained by the system. This can be done either by entering a number determined as a function of the engine type or by performing the steps described above to obtain a first current magnitude that is then used as the first reference magnitude because it is known that the engine is in proper operating condition. If the reference magnitude is not available, as determined at functional block 101, the system obtains the reference magnitude at functional block 102 and proceeds to point B with that reference magnitude stored for future use. At functional block 103, a first current magnitude is obtained according to the steps described above. That first current magnitude is a result of the measuring, filtering, rectifying, and integrating steps relating to the data within a preselected window, such as the window between dashed lines 82 and 84 or the window between dashed lines 86 and 88. That first current magnitude is then compared, at functional block 104, to the first reference magnitude. The difference is interrogated at functional block 105. This could be an algebraic difference that is calculated by the microprocessor or, as in a preferred embodiment of the present invention, the difference is determined as a ratio of the first current magnitude to the first reference magnitude. As described above, this ratio is normally approximately equal to 1.0 immediately after the reference magnitude is obtained when the engine is known to be in proper operating condition. As time passes, the valve lash may change in such a way that this ratio increases from approximately 1.0 to a higher value. When that ratio reaches the threshold value, as determined at functional block 105, an alarm is provided as indicated by functional block 106. If the difference is not greater than the threshold value, the system returns to point A and repeats the process. If an alarm is provided, such as at functional block 106, various other steps can be taken to avoid repeated alarms. Although these are not shown in FIG. 3, the system can be designed so that a single alarm inhibits further alarms for a known time period so as not to provide an annoyance for the operator of the engine. However, if no action is taken to correct the situation, future alarms can again be generated.

Although the present invention has been described in particular detail and illustrated to show a preferred embodiment, it should be understood that alternative embodiments are also within its scope.

I claim:

1. A method for monitoring a valve system of an engine, comprising the steps of:

obtaining a first current magnitude of a parameter which is representative of an operating characteristic of said valve system corresponding to a first operating speed of said engine;

comparing said first current magnitude to a first reference magnitude;

determining an operating condition of said valve system of said engine as a function of a difference between said first current magnitude and said first reference magnitude, said first current magnitude of said parameter being determined by the step of measuring a first series of sensor output signals within a predefined window of the operational cycle of said valve system;

obtaining a second current magnitude of a parameter which is representative of an operating characteristic of said valve system corresponding to a second operating speed of said engine;

comparing said second current magnitude to a second reference magnitude corresponding to said second operating speed of said engine; and determining an operating condition of said valve system of said engine as a function of a difference between said second current magnitude and said second reference magnitude, said second current magnitude of said parameter being determined by the steps of;

(a) measuring a second series of sensor output signals within a predefined window of the operational cycle of said valve system;

(b) filtering the result of said measuring step according to a preselected range of frequencies;

(c) rectifying the result of said filtering step; and (d) integrating the results of said rectifying step to obtain said second current magnitude of a parameter which is representative of an operating characteristic of said valve system.

2. The method of claim 1, further comprising:

providing an output signal in response to a difference between said first current magnitude and said first reference magnitude which exceeds a predetermined threshold value.

3. The method of claim 1, wherein:

said first current magnitude of said parameter is determined by the steps of;

(a) measuring a first series of sensor output signals within a predefined window of the operational cycle of said valve system;

(b) filtering the result of said measuring step according to a preselected range of frequencies;

(c) rectifying the result of said filtering step; and (d) integrating the results of said rectifying step to obtain said first current magnitude of a parameter which is representative of an operating characteristic of said valve system.

4. The method of claim 1, wherein:

said parameter is an accelerometer signal magnitude which is representative of a magnitude of valve lash within said valve system.

5. The method of claim 1, wherein:

said parameter is a signal which is representative of a magnitude of vibration associated with the operation of said valve system.

6. The method of claim 1, wherein:

said first reference magnitude is preselected as a function of said engine.

7. The method of claim 1, wherein:

said first reference magnitude is obtained by storing a value of said current magnitude of a parameter which was earlier determined when said operating characteristic of said valve system was known to be within acceptable limits.

8. A method for monitoring a valve system of an engine, comprising the steps of:

obtaining a first current magnitude of a parameter which is representative of an operating characteristic of said valve system corresponding to a first operating speed of said engine;

comparing said first current magnitude to a first baseline magnitude;

determining an operating condition of said valve system of said engine as a function of a difference between said first current magnitude and said first baseline magnitude; and providing an output in response to a difference between said first current magnitude and said first baseline magnitude which exceeds a predetermined threshold value, said parameter being a signal which is representative of a magnitude of vibration associated with the operation of said valve system, said parameter being an accelerometer signal magnitude which is representative of a magnitude of valve lash within said valve system valve system, said first current magnitude of said parameter being determined by the step of;

(a) measuring a first series of sensor output signals within a predefined window of the operational cycle of said valve system;

(b) filtering the result of said measuring step according to a preselected range of frequencies;

(c) rectifying the result of said filtering step; and (d) integrating the results of said rectifying step to obtain said first current magnitude of a parameter which is representative of an operating characteristic of said valve system.

9. The method of claim 8, wherein:

said first baseline magnitude is obtained by storing a value of said current magnitude of a parameter which was earlier determined when said operating characteristic of said valve system was known to be within acceptable limits.

10. A method for monitoring a valve system of an engine, comprising the steps of:

obtaining a first current magnitude of a parameter which is representative of an operating characteristic of said valve system corresponding to a first operating speed of said engine;

comparing said first current magnitude to a first baseline magnitude;

determining an operating condition of said valve system of said engine as a function of a difference between said first current magnitude and said first baseline magnitude; wherein said determining step comprises the steps of (a) measuring a first series of sensor output signals within a predefined window of the operational cycle of said valve system;

(b) filtering the result of said measuring step according to a preselected range of frequencies;

(c) rectifying the result of said filtering step;

(d) integrating the results of said rectifying step to obtain said first current magnitude of a parameter which is representative of an operating characteristic of said valve system; and providing an output in response to a difference between said first current magnitude and said first baseline magnitude which exceeds a predetermined threshold value.

11. The method of claim 10, wherein:

said parameter is a signal which is representative of a magnitude of vibration associated with the operation of said valve system.

12. The method of claim 11, wherein:

said first baseline magnitude is obtained by storing a value of said current magnitude of a parameter which was earlier determined when said operating characteristic of said valve system was known to be within acceptable limits.

13. The method of claim 10, wherein:

said parameter is an accelerometer signal magnitude which is representative of a magnitude of valve lash within said valve system.

* * * * *